US009938051B2

(12) United States Patent
Harris

(10) Patent No.: US 9,938,051 B2
(45) Date of Patent: Apr. 10, 2018

(54) COVER FOR AN OPENING IN A CONTAINER

(71) Applicant: Brenda Louise Taylor Harris, Bronson, TX (US)

(72) Inventor: Brenda Louise Taylor Harris, Bronson, TX (US)

( * ) Notice: Subject to any disclaimer, the term of this patent is extended or adjusted under 35 U.S.C. 154(b) by 81 days.

(21) Appl. No.: 14/504,908

(22) Filed: Oct. 2, 2014

(65) Prior Publication Data

US 2015/0225138 A1 Aug. 13, 2015

Related U.S. Application Data

(60) Provisional application No. 61/886,300, filed on Oct. 3, 2013.

(51) Int. Cl.
*B65D 43/18* (2006.01)
*B65D 17/00* (2006.01)

(52) U.S. Cl.
CPC ..... *B65D 43/18* (2013.01); *B65D 17/161* (2013.01); *B65D 17/166* (2013.01); *B65D 2517/0044* (2013.01)

(58) Field of Classification Search
CPC ..... B65D 17/166; B65D 43/18; B65D 2517/0014; B65D 2517/0044; B65D 17/161
USPC ..... 220/254.4, 821, 269
See application file for complete search history.

(56) References Cited

U.S. PATENT DOCUMENTS

| | | | | |
|---|---|---|---|---|
| 3,952,911 | A | 4/1976 | Bozek et al. | |
| 4,609,123 | A | 9/1986 | Poncy | |
| 4,821,912 | A | 4/1989 | Wells | |
| 4,852,763 | A * | 8/1989 | Dimberio | B65D 47/265 220/253 |
| 4,887,712 | A | 12/1989 | Wells | |
| D315,872 | S | 4/1991 | Bixler | |
| 5,779,087 | A | 7/1998 | Sharpe et al. | |
| 5,967,726 | A * | 10/1999 | Turner et al. | 413/25 |
| 6,059,137 | A | 5/2000 | Westwood et al. | |
| 6,098,830 | A * | 8/2000 | Jamieson | B65D 17/166 220/258.2 |
| 6,138,856 | A * | 10/2000 | Ghim | B65D 17/165 220/269 |
| 6,755,315 | B1 * | 6/2004 | Mueller | B65D 17/165 220/254.1 |
| 7,407,061 | B2 | 8/2008 | Fares et al. | |
| 2005/0051553 | A1 * | 3/2005 | Li et al. | 220/254.4 |
| 2005/0236411 | A1 * | 10/2005 | Huffman et al. | 220/254.4 |
| 2007/0051725 | A1 * | 3/2007 | Glade | B65D 51/007 220/254.4 |

(Continued)

OTHER PUBLICATIONS

Definition of the term "unitary", and definition of "unit". Dictionary.com based on Random House Dictionary, Random House, Inc. http://www.dictionary.com/ (Oct. 2017).*

*Primary Examiner* — James N Smalley
(74) *Attorney, Agent, or Firm* — Lee & Hayes, PLLC

(57) ABSTRACT

A container includes a movable cover for an opening of the container. The cover can be attached to the container to rotate from a first position to a second position to be disposed over the opening in the container. When the cover is in the first position, the opening is at least substantially uncovered, and when the cover is in the second position, the opening is at least substantially covered.

12 Claims, 4 Drawing Sheets

(56) References Cited

U.S. PATENT DOCUMENTS

| | | | | |
|---|---|---|---|---|
| 2011/0155737 | A1* | 6/2011 | Brandtner | B65D 17/166<br>220/326 |
| 2012/0012586 | A1 | 1/2012 | Rinderer et al. | |

* cited by examiner

COVER FOR AN OPENING IN A CONTAINER

PRIORITY CLAIM AND CROSS-REFERENCE TO RELATED APPLICATON

This application claims the benefit of, and priority to, U.S. Provisional Patent Application No. 61/866,300, filed Oct. 3, 2013, which is incorporated by Reference herein in its entirety.

BACKGROUND

Containers include mechanisms to access contents stored in the containers. These mechanisms can cause an opening to be formed in the container. In situations where the container is storing a liquid, the liquid can be poured from the opening. Additionally, when the container is a beverage container, an individual can drink the beverage directly from the opening in the container. In some cases, the opening formed in the container can be produced by using a tab attached to the container to puncture a portion of the container. In other instances, the opening can be formed by a device external to the container, such as a device including a sharp edge, a blade, and the like.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
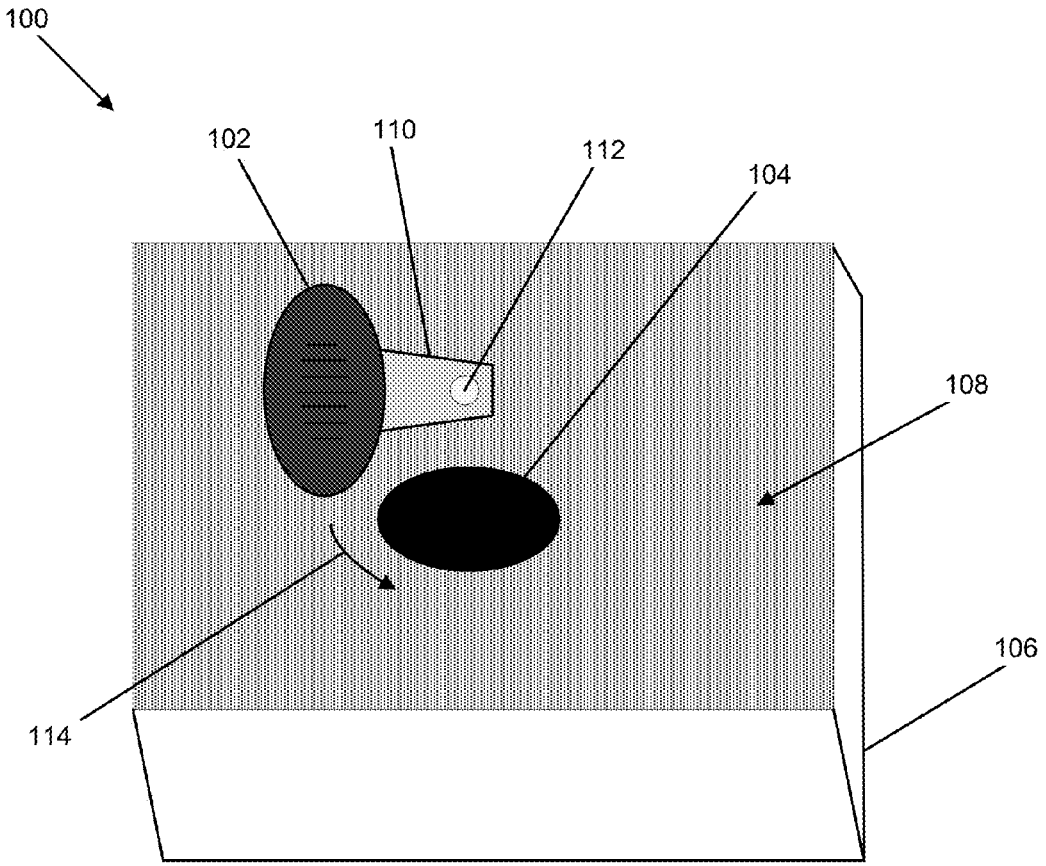
FIG. 1 is a perspective view of an embodiment of a container having a cover for an opening in the container.

This disclosure is directed to a container having a cover to cover an opening in the container. In some cases, the opening can be formed by puncturing a portion of the beverage container. In these situations, the portion of the beverage container being punctured is often bent down into the beverage container and inaccessible to an individual using the beverage container. Thus, individuals are typically unable to use the punctured portion of the beverage container to reseal the opening in the beverage container. This scenario is often frustrating for an individual using the beverage container because the liquid contained in the beverage container can easily spill causing inconvenience and frustrations for the individual. Additionally, the contents of the beverage container can be contaminated with dust, insects, food, or other debris through the opening and, in some cases, the contents of the beverage container can lose their freshness after being exposed to air through the opening.

In embodiments described herein, a container can include a cover that covers an opening in the container. The cover can be attached to the container to rotate from a first position to a second position to be disposed over the opening in the container. When the cover is in the first position, the opening is at least substantially uncovered, and when the cover is in the second position, the opening is at least substantially covered. In some cases, the cover can be attached to the container, such that the cover can be readily removed from the container with minimal, if any, damage to the container. In other cases, the cover can be attached in a manner, such that the removal of the cover can cause damage to the container. The cover can also include grip features to facilitate the rotation of the cover to disposed over the opening.

By providing a cover that is rotatable to overlay an opening in the container, an individual using the container can avoid contents of the container spilling out of the container. Additionally, individuals can reuse the container after emptying the container. For example, an individual can dispose additional material, such as a fluid or solid object in an empty container through the opening and then cover the opening using the rotatable cover. Thus, individuals can have a more convenient experience with containers produced according to embodiments described herein because spilling content from the containers can be minimized or eliminated. Further, individuals can reduce costs by reusing containers produced according to embodiments described herein. Providing covers for openings of containers can also protect the contents of the container from bugs, debris, dust, or other contaminants. In situations when the container includes a food item, containers having covers according to embodiments described herein can preserve the freshness of the food item. Also, in the case of carbonated beverages, the carbonation of the beverage can be preserved by covering the opening of the container with a rotatable cover according to embodiments described herein.

FIG. 1 is a perspective view of an embodiment of a container 100 having a cover 102 for an opening 104 in the container 100. The container 100 can include a body 106. The body 106 can include a top portion 108. In some cases, the body 106 can be a unitary body with the top portion 108 integrated as part of the body 106. In other cases, the top portion 108 can serve as a lid that is removably coupled to the body 106. For example, the top portion 108 can include grooves that enable the top portion 108 to be snapped on to edges of the body 106. In another example, the top portion 108 can include fasteners to couple the top portion 108 to the body 106. To illustrate, the top portion 108 can include flaps that fold down and couple to a portion of the body 106, such as one or more flanges formed in the body 106.

In some situations, the body 106 and the top portion 108 can be formed from substantially similar materials. In other situations, the body 106 and the top portion 108 can be formed from different materials. In an illustrative example, the body 106, the top portion 108, or both can include a plastic material. In another illustrative example, the body 106, the top portion 108, or both can include a metal material.

Additionally, dimensions of the body 106 and the corresponding dimensions of the top portion can vary depending on the application for which the container 100 is being used. For example, the body 106 can have a length that is included in a range of about 4 cm to about 15 cm. In another example, the body 106 can have a length that is included in a range of about 15 cm to about 40 cm. In still other examples, the body 106 can have a length that is included in a range of about 25 cm to about 60 cm. In further examples, the body 106 can have a length that is included in range of about 50 cm to about 110 cm.

Further, the body 106 can have a width that is included in a range of about 4 cm to about 15 cm. In another example, the body 106 can have a width that is included in a range of about 15 cm to about 40 cm. In still other examples, the body 106 can have a width that is included in a range of about 25 cm to about 60 cm. In additional examples, the body 106 can have a width that is included in range of about 50 cm to about 110 cm.

Also, the body 106 can have a height that is included in a range of about 4 cm to about 15 cm. In another example, the body 106 can have a height that is included in a range of about 15 cm to about 40 cm. In still other examples, the body 106 can have a height that is included in a range of about 25 cm to about 60 cm. In further examples, the body 106 can have a height included in a range of about 50 cm to about 110 cm.

When the body 106 has a circular shape, the body 106 can have a diameter included in a range of about 4 cm to about 10 cm. In addition, the body 106 can have a diameter included in a range of about 8 cm to about 20 cm. In some embodiments, the body 106 can have a diameter included in a range of about 18 cm to about 50 cm. In still other embodiments, the body 106 can have a diameter included in a range of about 40 cm to about 100 cm.

The opening 104 can have dimensions of various magnitudes. For example, when the opening 104 has an ellipse shape, the opening 104 can have a major axis included in a range of about 0.5 cm to about 5 cm. In another example, the opening 104 can have a major axis included in a range of about 4 cm to about 15 cm. In still other examples, the opening 104 can have a major axis included in a range of about 12 cm to about 30 cm. Further, the when the opening 104 has an ellipse shape, the opening 104 can have minor axis included in a range of about 0.2 cm to about 4 cm. In other embodiments, the opening 104 can have a minor axis included in a range of about 3 cm to about 8 cm. Additionally, the opening 104 can have a minor axis included in a range of about 7 cm to about 20 cm.

In examples, when the opening 104 has a circular shape, the opening can have a diameter included in a range of about 0.5 cm to about 5 cm. Additionally, the opening 104 can have a diameter included in a range of about 3 cm to about 10 cm. Furthermore, the opening 104 can have a diameter included in a range of about 8 cm to about 25 cm.

In situations when the opening 104 has a square or rectangular shape, the opening 104 can have a width, a length, or both included in a range of about 0.5 cm to about 7 cm. In addition, the opening 104 can have a width, a length, or both included in a range of about 3 cm to about 15 cm. Further, the opening 104 can have a width, a length, or both included in a range of about 12 cm to about 30 cm.

In some embodiments, the cover 102 can have dimensions similar to those of the opening 104. For example, the cover 102 can have dimensions that are larger than those of the opening 104 such that when the cover 102 is slid over the opening 104, a portion of the cover 102 is disposed over the opening 104 and another portion of the cover 102 rests on the top portion 108. In other examples, the cover can have dimensions such that when the cover 102 is slid over the opening 104, the cover 102 is disposed within the opening 104 and forms at least a partial seal with the top portion 108. In illustrative embodiments, the cover 102 can have dimensions with values that are at least about 95% of the values of the dimensions of the opening 104, at least about 99% of the values of the dimensions of the opening 104, at least about 100% of the values of the dimensions of the opening 104, at least about 101% of the values of the dimensions of the opening 104, at least about 102% of the values of the dimensions of the opening 104, or at least about 105% of the values of the dimensions of the opening 104. In a particular illustrative embodiment, the values of the dimensions of the cover 102 are included in a range of about 97% of the values of the dimensions of the opening 104 to about 103% of the values of the dimensions of the opening 104.

The cover 102 can be coupled to the top portion via a coupling member 110 and an attachment member 112. In some embodiments, the cover 102 and the coupling member 110 can be formed from a unitary piece of material. In other situations, the cover 102 can be attached to the coupling member 110 using a mechanical process or a chemical process, such as welding. In various embodiments, the attachment member 112 can be a rivet that attaches the coupling member 110 to the top portion 108. In other scenarios, the attachment member 112 can be a weld. Additionally, the coupling member 110 can be removably attached to the attachment member 112. In one example, the coupling member 110 can include a forked region to clamp to the attachment member 112. In another example, the attachment member 112 can include a pin with a head, where the head holds the coupling member 110 against the top portion 108. In these instances, the pin can be removed from the top portion and the coupling member 110 can then be disengaged from the top portion 108.

The coupling member 110 can rotate around the attachment member 112. For example, the coupling member 110 can rotate around the attachment member 112 in a direction 114. The coupling member 110 can rotate around the attachment member 112 in the direction 114 until the cover 102 covers the opening 104. As the cover 102 and the coupling member 110 move in the direction 114, the portions of the cover 102, portions of the coupling member 110, or portions of both the cover 102 and the coupling member 110 can be in contact with the top portion 108. In other situations, as the cover 102 and the coupling member 110 move in the direction 114, the portions of the cover 102, portions of the coupling member 110, or portions of both the cover 102 and the coupling member 110 can move above the top portion 108 and not contact the top portion 108. Further, in some cases, when not in motion, at least a portion of the cover 102 and at least a portion of the coupling member 110 can rest on the top portion 108 and contact the top portion 108. In various embodiments, the cover 102 and the coupling member 110 can rest above the top portion 108 without contacting the top portion 108.

In some cases, a first side of the cover 102 that covers the opening 104 (i.e., the bottom side in FIG. 1), can have some curvature so that a portion of the cover 102 fits inside of the opening 104 and is disposed below the upper surface of the top portion 108. Additionally, the first side of the cover 102 that covers the opening 104 can include a portion that can be pressed down or otherwise disposed into the opening 104. In this way, spilling contents out of the container 100 can be further minimized or eliminated. Further, a second side of the cover 102 that is opposite the first side can include a material to aid in the movement of the cover 102. For example, the second side of the cover 102 can include a grip feature. In some cases, the grip feature can be textured. In an illustrative example, the grip feature can include one or more ridges. In addition, the grip feature can include one or more different materials than the coupling member 110. To illustrate, the grip feature can be formed from a fabric material, a plastic material, or a combination thereof. The coupling member 110 can include a metal material in some embodiments. In other embodiments, the coupling member 110 can include a plastic material.

Although, the cover 102 illustrated in FIG. 1 has an oval shape or ellipse shape, in other embodiments, the cover 102 can have a number of other shapes. For example, the cover 102 can have a different rounded shape, such as a circle. In another example, the cover 102 can have a rectangular shape. In other examples, the cover 102 can have a square shape. In additional examples, the cover 102 can have a triangular shape. In still other examples, the cover 102 can be formed from a material that allows the shape of the cover 102 to be modified. In some embodiments, the cover 102 can have a shape that substantially matches a shape of the opening 104.

Figure 2:
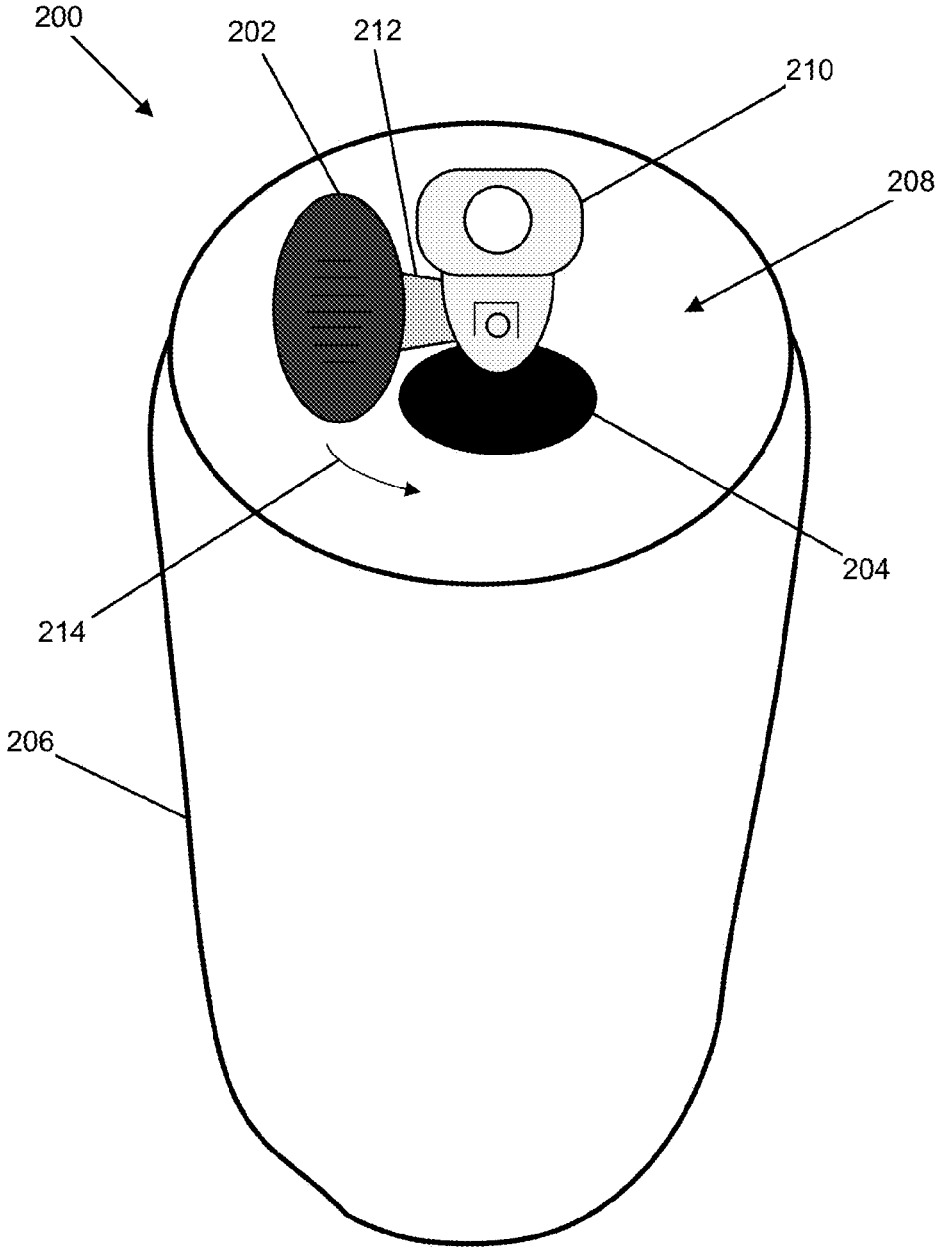
FIG. 2 is a perspective view of an embodiment of a beverage container having a cover for an opening in the beverage container.

FIG. 2 is a perspective view of an embodiment of a beverage container 200 having a cover 202 for an opening 204 in the beverage container 200. The beverage container 200 can be formed from one or more materials, including a metal material. For example, the beverage container 200 can include aluminum. In another example, the beverage container 200 can include alloys of aluminum.

The beverage container 200 includes a unitary body 206 having a top portion 208. The body 206 can form a cavity that holds contents of the beverage container. The opening 204 is formed in the top portion 208 and provides access to a beverage in the beverage container 200. The beverage container 200 can also include a tab 210. The tab 210 can be movable to cause a portion of the top portion 208 to bend into the cavity formed by the body 206 and form the opening 204. In an illustrative embodiment, the tab 210 can be bent in a forward direction to form the opening 204 and then bent in a backward position toward an originating location for the tab 210. In some instances, the tab 210 can be removed from the top portion 208 by bending the tab 210 a number of times sufficient to cause the connection between the tab 210 and the top portion 208 to fail. The tab 210 can be coupled to the top portion 208 via a suitable mechanism. For example, the tab 210 can be coupled to the top portion 208 via a rivet or a weld.

In some embodiments, the tab 210 can be formed from one or more materials that are the same or similar to one or more materials used to form the body 206. In other embodiments, the tab 210 can be from one or more materials that are different from one or more materials used to form the body 206. In an illustrative example, the tab 210 can include aluminum. In another illustrative example, the tab 210 can include an alloy of aluminum.

In some cases, the cover 202 can be coupled to the top portion 208 using a coupling member 212. In various embodiments, the coupling member 212 can be rotatably attached to the top portion 208. In a particular embodiment, the coupling member 212 can be rotatably attached to the top portion 208 via the tab 210. The coupling member 212 and the cover 202 can be formed from a unitary piece of material in some cases, while in others, the coupling member 212 and the cover 202 can be separate pieces. The coupling member 212 can rotate around an axis such that the cover 202 can move in a direction 214 to rest over the opening 204. After placing the cover 202 over the opening, the coupling member 212 can be moved further in the direction 214 or in a direction opposite the direction 214 to at least partially expose the opening 204. In some embodiments, while the coupling member 212 is being rotated, the tab 210 remains in a substantially fixed position. To illustrate, in some cases, the tab 210 does not move along the direction 214 as the coupling member 212 moves along the direction 214.

The beverage container 200 can have suitable dimensions similar to those described with respect to the container 100 of FIG. 1. For example, the beverage container 200 can have a radius included in a range of about 2 cm to about 15 cm. In addition, the beverage container 200 can have a height included in a range of about 5 cm to about 30 cm. Further, the opening 204 can have a major axis included in a range of about 0.4 cm to about 5 cm and a minor axis included in a range of about 0.2 cm to about 4 cm. In some embodiments, the cover 202 can have a major axis included in a range of about 0.5 cm to about 6 cm and a minor axis included in a range of about 0.3 cm to about 5 cm.

Figure 3:
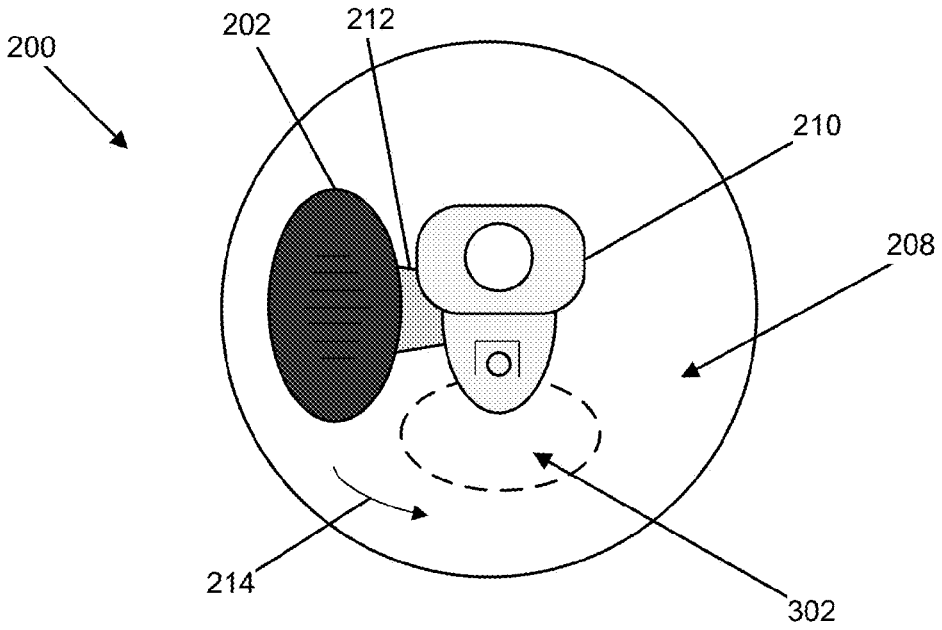
FIG. 3 is a top view of an embodiment of a beverage container before an opening is produced in the beverage container.

FIG. 3 is a top view of an embodiment of the beverage container 200 before an opening is produced in the beverage container 200. In the illustrated embodiment of FIG. 3, the top portion 208 of the beverage container 200 can include a movable portion 302. The movable portion 302 can be formed in the top portion 208 such that the movable portion 302 bends into a cavity of the beverage container 200 when a force is applied on the movable portion 302. In some embodiments, a force can be applied to the top of the movable portion 302 by bending the tab 210 in a forward direction, that is, in a direction toward the movable portion 302. In some cases, the movable portion 302 can be formed by a perforated portion of the top portion 208 or by some other technique of producing a weakness in the top portion 208 that matches a shape of the movable portion 302. In various embodiments, the coupling member 212 can rotate in the direction 214 over the movable portion 302. Additionally, after being bent into the cavity of the beverage container 200, at least a portion of the movable portion 302 can remain connected to the top portion 208, in some embodiments.

Figure 4:
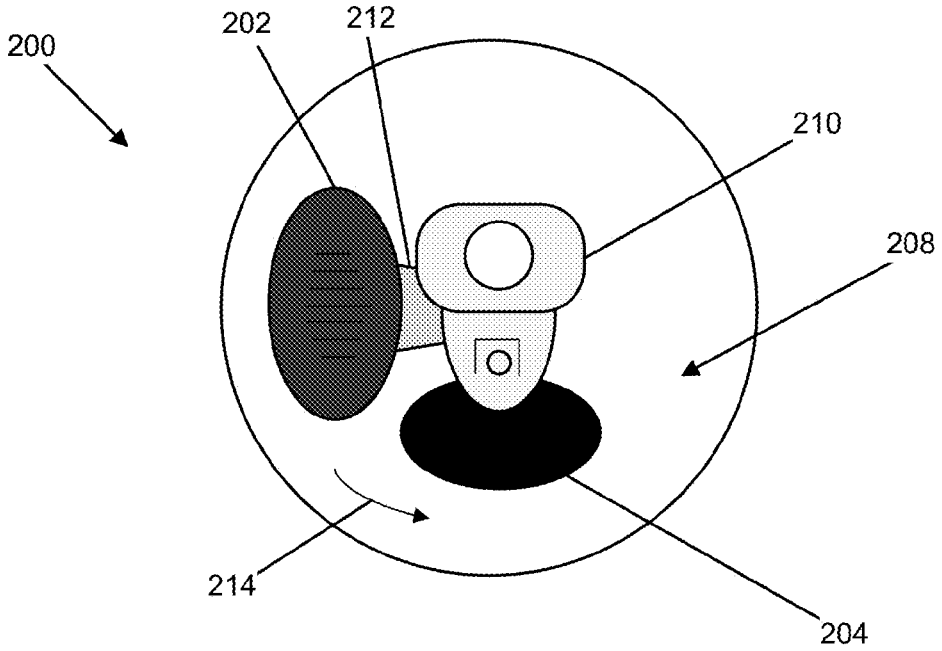
FIG. 4 is a top view of an embodiment of a beverage container having an opening and having a cover in a first position.

FIG. 4 is a top view of an embodiment of the beverage container 200 having the opening 204 and having the cover 202 in a first position. In an embodiment, the opening 206 can be formed by movement of the tab 210. When the cover 202 is in the first position, the opening 204 is exposed and uncovered. The coupling member 212 can be moved in the direction 214 such that the cover 202 is disposed over the opening 204.

Figure 5:
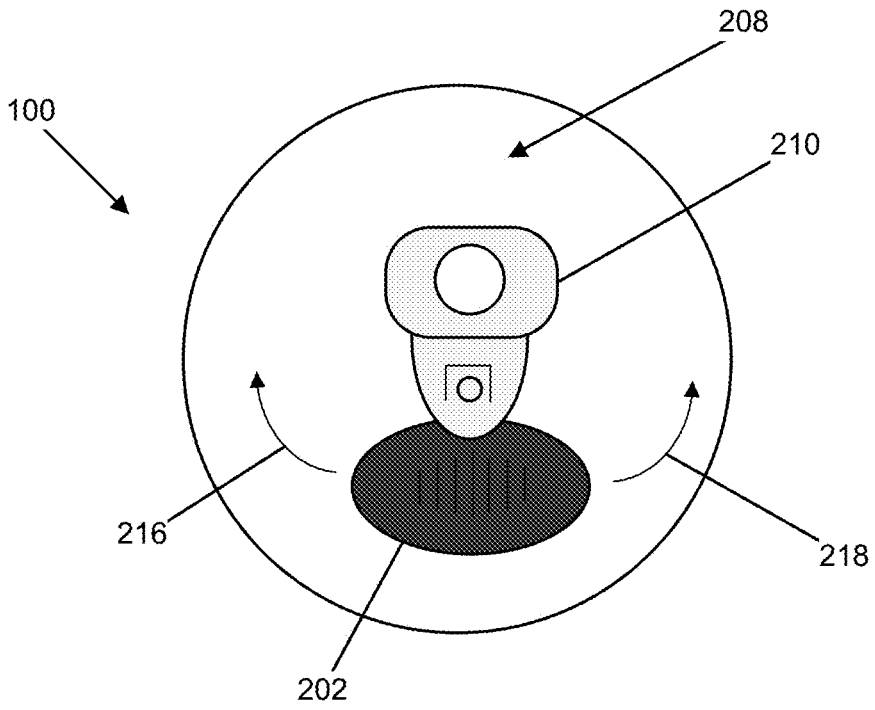
FIG. 5 is a top view of an embodiment of a beverage container having a cover in a second position covering an opening in the beverage container.

FIG. 5 is a top view of an embodiment of the beverage container 200 having the cover 202 in a second position covering an opening in the beverage container 200. When the cover 202 is in the second position, the cover 202 can be disposed over an opening in the beverage container 200, such as the opening 204 of FIG. 2 and FIG. 4. The tab 210 can remain in substantially the same position on the top portion 208 when moving the cover 202 from the first position to the second position. Additionally, the cover 202 can be moved in a second direction 216 or a third direction 218 to expose at least a portion of an opening in the beverage container 200.

This disclosure provides various example embodiments, as described and as illustrated in the drawings. However, this disclosure is not limited to the embodiments described and illustrated herein, but can extend to other embodiments, as would be known or as would become known to those skilled in the art. Reference in the specification to "one embodiment," "this embodiment," "these embodiments" or "some embodiments" means that a particular feature, structure, or characteristic described is included in at least one embodiment, and the appearances of these phrases in various places in the specification are not necessarily all referring to the same embodiment.

What is claimed is:

1. A container comprising:

a body having a top portion, wherein the body forms a cavity and an opening is formed in the top portion;

a tab coupled to the top portion;

an attachment member disposed on the top portion;

a coupling member having a forked region to clamp the coupling member to the attachment member; and a cover coupled to the attachment member via the coupling member such that the coupling member is rotatable to move the cover over the opening while the tab remains in a substantially fixed position, the cover having a shape that substantially matches a shape of the opening, the cover having a different shape from the coupling member, and wherein values of dimensions of the cover are included in a range of about 97% of the values of the dimensions of the opening to about 103% of the values of the dimensions of the opening.

2. The container of claim 1, wherein the top portion is a lid coupled to the container.

3. The container of claim 1, wherein the body is a unitary body that includes the top portion.

4. The container of claim 1, wherein the coupling member is removably attached to the attachment member.

5. The container of claim 1, wherein the attachment member is removably attached to the top portion.

6. The container of claim 1, wherein the cover is disposed over the opening and at least a portion of the cover is disposed within the opening and below a surface of the top portion.

7. The container of claim 1, wherein the cover contacts a portion of the top portion when the cover is disposed over the opening.

8. The container of claim 1, wherein the cover has a shape that substantially matches a shape of the opening.

9. The container of claim 1, wherein the cover includes a grip feature having one or more ridges.

10. The container of claim 9, wherein the grip feature includes a material different from a material of the coupling member.

11. The container of claim 1, wherein the cover has a shape that is at least substantially similar to a shape of the opening.

12. The container of claim 1, wherein the coupling member and the cover are formed from a unitary piece of material.

* * * * *